US007761016B2

(12) United States Patent
Kim

(10) Patent No.: US 7,761,016 B2
(45) Date of Patent: Jul. 20, 2010

(54) OVERHEATING CONTROL AND METHOD IN AN IMAGE FORMING APPARATUS

(75) Inventor: Jin Sil Kim, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 80 days.

(21) Appl. No.: 12/017,703

(22) Filed: Jan. 22, 2008

(65) Prior Publication Data

US 2008/0181632 A1 Jul. 31, 2008

(30) Foreign Application Priority Data

Jan. 25, 2007 (KR) ..... 10-2007-0007847

(51) Int. Cl.
*G03G 15/20* (2006.01)

(52) U.S. Cl. ..... 399/33

(58) Field of Classification Search ..... 399/33, 399/67, 69

See application file for complete search history.

(56) References Cited

U.S. PATENT DOCUMENTS 4,538,902 A * 9/1985 Inuzuka et al. ..... 399/33
6,097,904 A * 8/2000 Tsuruno et al. ..... 399/33
2008/0232831 A1 * 9/2008 Kwon ..... 399/33

FOREIGN PATENT DOCUMENTS

JP 2003-167470 6/2003

OTHER PUBLICATIONS

Chinese Office Action issued Jul. 3, 2009 in CN Application No. 2008100966488.

* cited by examiner

*Primary Examiner*—Quana M Grainger
(74) *Attorney, Agent, or Firm*—Stanzione & Kim, LLP

(57) ABSTRACT

An image forming apparatus to prevent overheating of a fuser. In the image forming apparatus, a first overheating prevention unit compares the voltage detected by a temperature sensor, which senses temperature of the fuser, with a reference voltage and turns off the fuser when it overheats. A controller receives the detected voltage through an A/D port and performs on/off control of the fuser to keep its temperature at a predetermined level. A second overheating prevention unit compares the detected voltage with the A/D port voltage and turns off the fuser when the detected voltage is different from the A/D port voltage. When the A/D port is damaged, the A/D port voltage increased by the damage activates the second overheating prevention unit to turn off the fuser. This prevents overheating of the fuser caused by malfunction of the A/D port, thereby preventing disconnection of the thermostat or scorch of the fuser.

18 Claims, 3 Drawing Sheets

OVERHEATING CONTROL AND METHOD IN AN IMAGE FORMING APPARATUS

CROSS-REFERENCE TO RELATED APPLICATIONS

This application claims priority under 35 U.S.C. §119(a) from Korean Patent Application No. 2007-0007847, filed on Jan. 25, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus and a method thereof, and more particularly, to an image forming apparatus capable of protecting a system of the image forming apparatus when a fuser provided in the apparatus overheats, and a method thereof.

2. Description of the Related Art

A conventional image forming apparatus includes a charger, a laser scanning unit as an exposure unit, a developer, a transfer unit, a fuser, etc., around a photosensitive drum. A surface of the photosensitive drum charged by the charger is exposed to a beam of a laser scanning unit to form a latent image on the surface of the photosensitive drum. The developer develops the latent image into a toner image. The transfer unit transfers the toner image to a record medium. The record medium is discharged outside after the fuser fuses the toner image onto the record medium.

The fuser heats a sheet of paper carrying a toner image transferred thereto and temporarily fuses the powdery toner image on the sheet to fix the image to the sheet. To accomplish this, the fuser includes a fuser roller to fuse toner to a sheet of paper and a pressure roller to push the sheet toward the fuser roller. A heat lamp is provided in the fuser roller at its internal center. The fuser is heated by heat radiated from the heat lamp.

A thermistor is provided at a portion of the fuser roller at which it contacts the outer surface of the fuser roller to measure surface temperature of the fuser roller, and a thermostat is also provided to turn off power to the heat lamp when the surface temperature of the fuser roller has exceeded a preset level. The thermistor measures and transmits the surface temperature of the fuser roller to a microcomputer of the image forming apparatus. According to the measured surface temperature of the fuser roller, the microcomputer controls power supplied to the heat lamp to keep the surface temperature of the fuser roller within a predetermined temperature range. When the temperature of the fuser roller is higher than a preset upper limit, an internal connection of the thermostat is opened to turn off power supplied to the heat lamp.

As illustrated in FIG. 1, the conventional image forming apparatus includes a thermistor R4, an analog-to-digital (A/D) port (THERM_IN) of the microcomputer, an output port (nFUSER_EN) of the microcomputer, transistors Q1 and Q2, and a comparator U1A. The thermistor R4 senses surface temperature of the fuser roller. The microcomputer A/D converts and reads a voltage detected by the thermistor R4 through the A/D port (THERM_IN). The microcomputer compares the read voltage (Vadc2) with a fuser table previously stored in ROM and outputs a control signal to perform on/off control of the heat lamp through the output port (nFUSER_EN). The transistor Q2 is turned on or off according to the control signal. The transistor Q1 detects opening of the thermistor R4. The comparator U1A turns off the heat lamp when the fuser roller overheats.

The following is a description of how the conventional image forming apparatus of FIG. 1 operates. The microcomputer 31 A/D converts and reads the voltage detected by the thermistor R4 through the A/D port (THERM_IN). The microcomputer compares the read voltage with the fuser table previously stored in the ROM and determines whether to turn on or off the heat lamp. The microcomputer then outputs a value corresponding to the determination through the output port (nFUSER_EN). The voltage detected by the thermistor R4 is applied to a positive (+) input of the comparator U1A, which is a non-inverting input of the comparator U1A. The comparator U1A compares the detected voltage applied to the positive input with a reference level applied to the negative input, which is an inverting input of the comparator U1A. If the voltage applied to the positive input is lower than or equal to the reference level, the comparator U1A outputs a low signal. If the voltage applied to the positive input is higher than the reference level, the comparator U1A outputs a high signal. Accordingly, a voltage level associated with a predetermined temperature range is implemented using a reference level circuit so that the comparator U1A outputs a high signal in a normal operating state controlled at a temperature within an allowable temperature range, and outputs a low signal in an abnormal operating state controlled at a temperature outside the allowable temperature range. Accordingly, when the output of the comparator U1A is a high signal, the heat lamp is turned on or off according to an output value of the output port (nFUSER_EN) of the microcomputer. However, when the output of the comparator U1A is a low signal, the heat lamp is turned off regardless of the output value of the output port (nFUSER_EN) of the microcomputer. When the thermistor R4 is opened, the transistor Q1 connected to the thermistor R4 is turned off to switch the output of the comparator U1A to a low signal to prevent the risk of keeping the heat lamp on.

The following are some problems associated with the conventional image forming apparatus of FIG. 1. When the A/D port (THERM_IN) of the microcomputer is brought into an uncontrollable state, and thus the A/D (THERM_IN) port applies a certain voltage, the Vadc2 voltage becomes higher than the Vadc1 voltage. This causes a higher Vadc1 voltage than its original level to be applied to the non-inverting (positive) input of the comparator U1A through a damping resistor R3. That is, although the Vadc1 and Vadc2 voltages must have the same level under a normal condition, the level of the Vadc2 voltage is higher than that of the Vadc1 voltage to cause an increase in the level of the Vadc1 voltage. Since the level of the Vadc1 voltage is increased to be higher than the reference voltage applied to the inverting (negative) input of the comparator U1A, a normal operating state is detected to make it impossible to perform on/off control of the heat lamp through the comparator U1A. For example, since the A/D port (THERM_IN) of the microcomputer is damaged by external factors, even when the temperature of the fuser roller is very high, the voltage level of the positive input of the comparator U1A is higher than the reference voltage of the negative input so that the hardware control using the comparator U1A is deactivated to keep the heat lamp on. When the transistor Q2 is kept on according to the signal of the output port (nFUSER_EN) of the microcomputer, AC power is constantly applied to the heat lamp to continue heating the fuser roller until the thermostat is disconnected. In addition, even when the comparator U1A outputs a low signal, heat may scorch the fuser roller or disconnect the thermostat since the response to the temperature increase of the fuser roller is slow, thereby requiring the fuser roller to be repaired.

Thus, when an abnormal operation has occurred due to damage to the A/D port (THERM_IN) of the microcomputer, it is necessary to turn off the heat lamp, regardless of whether the microcomputer performs normal control, thereby preventing scorch of the fuser or disconnection of the thermostat, which causes inconvenience to the user.

SUMMARY OF THE INVENTION

The present general inventive concept provides an image forming apparatus which can prevent overheating of a fuser caused by damage to an A/D port of a microcomputer.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus to prevent overheating of a fuser, the apparatus including a temperature sensor to sense temperature of the fuser, a first overheating prevention unit to compare a voltage detected by the temperature sensor with a preset reference voltage and to turn off the fuser when the fuser overheats, a controller to receive the voltage detected by the temperature sensor through an A/D port and to perform on/off control of the fuser to keep the temperature of the fuser at a predetermined level, and a second overheating prevention unit to compare the voltage detected by the temperature sensor with voltage of the A/D port and to turn off the fuser when the detected voltage is different from the voltage of the A/D port.

The temperature sensor may include a thermistor to sense surface temperature of a fuser roller in the fuser.

The first overheating prevention unit may output a signal to turn on the fuser if the voltage detected by the temperature sensor is higher than the preset reference voltage and may output a signal to turn off the fuser if the voltage detected by the temperature sensor is less than or equal to the preset reference voltage.

The controller may include a microcomputer to read the voltage detected by the temperature sensor through an A/D port and to output a control signal through an output port, the control signal causing temperature corresponding to the read voltage to be kept at a preset target temperature, and a first switching unit that is turned on or off according to the control signal output from the microcomputer to turn on or off the fuser.

The second overheating prevention unit may include a second comparator to output a first signal if the voltage of the A/D port is higher than the detected voltage and to output a second signal if the voltage of the A/D port is less than or equal to the detected voltage, and a second switching unit that is turned on or off according to the first signal output from the second comparator to turn on or off the fuser.

The foregoing and/or other aspects and utilities of the present general inventive concept may also be achieved by providing an image forming apparatus to prevent overheating of a fuser, the apparatus including a temperature sensor to detect a voltage which corresponds to temperature of the fuser, a controller to output a control signal to turn the fuser on or off based on the voltage detected by the temperature sensor in order to maintain a target temperature of the fuser, and an overheating prevention unit to compare the detected voltage to a reference voltage and to turn the fuser on or off based on a signal produced by the comparison and the control signal output from the controller.

The fuser may turn on only if the comparison signal is in a fuser-on state and the control signal is in a fuser-on state.

The controller may include a microcomputer to read the voltage detected by the temperature sensor through an A/D port and to output the control signal.

The image forming apparatus may further include another overheating prevention unit to compare a voltage at the A/D port with the voltage detected by the temperature sensor to turn the fuser off or to maintain a current state of the fuser.

The another overheating prevention unit may turn the fuser off when the voltage at the A/D port is higher than the detected voltage.

The another overheating prevention unit may turn the fuser off when the A/D port is damaged.

The microcomputer may output the control signal to a switching unit which controls whether the fuser turns on or off.

The fuser may turn on when the switching unit is off and the fuser may turn off when the switching unit is on.

The fuser may be turned on if the voltage detected by the temperature sensor is higher than the reference voltage.

The foregoing and/or other aspects and utilities of the present general inventive concept may also be achieved by providing a method of controlling a fuser in an image forming apparatus, the method including detecting a voltage of the fuser which corresponds to temperature of the fuser, comparing the detected voltage with a preset reference voltage to turn off the fuser when the fuser overheats, receiving the detected voltage through an A/D port to perform on/off control of the fuser to keep the temperature of the fuser at a predetermined level, and comparing the detected voltage with a voltage of the A/D port to turn off the fuser when the detected voltage is different from the voltage of the A/D port.

The method may further include outputting a first signal if the voltage of the A/D port is higher than the detected voltage, and outputting a second signal if the voltage of the A/D port is less than or equal to the detected voltage The foregoing and/or other aspects and utilities of the present general inventive concept may also be achieved by providing a method of controlling a fuser in an image forming apparatus, the method including detecting a voltage which corresponds to temperature of the fuser, outputting a control signal to turn the fuser on or off based on the detected voltage in order to maintain a target temperature of the fuser, comparing the detected voltage to a reference voltage, and turning the fuser on or off based on a signal produced by the comparison and the output control signal.

The method may further include reading the voltage detected by the temperature sensor through an A/D port.

The method may further include comparing a voltage at the A/D port with the voltage detected by the temperature sensor to turn the fuser off or to maintain a current state of the fuser.

The fuser may be turned off when the voltage at the A/D port is higher than the detected voltage.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
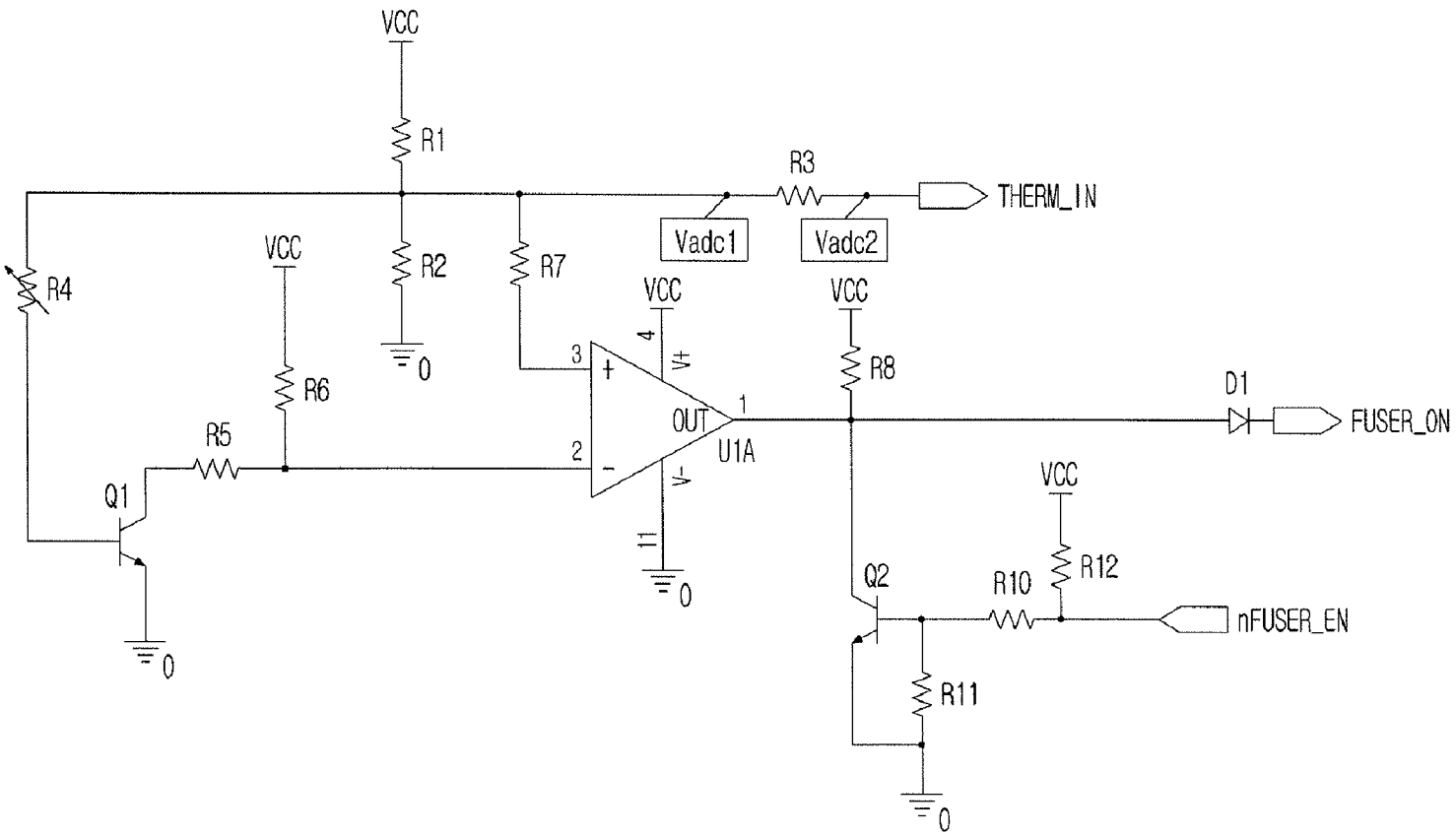
FIG. 1 (RELATED ART)
FIG. 1 is a schematic circuit diagram of a conventional image forming apparatus.

Reference will now be made in detail to the embodiments of the present general inventive concept, examples of which are illustrated in the accompanying drawings, wherein like reference numerals refer to the like elements throughout. The embodiments are described below to explain the present general inventive concept by referring to the figures.

Figure 2:
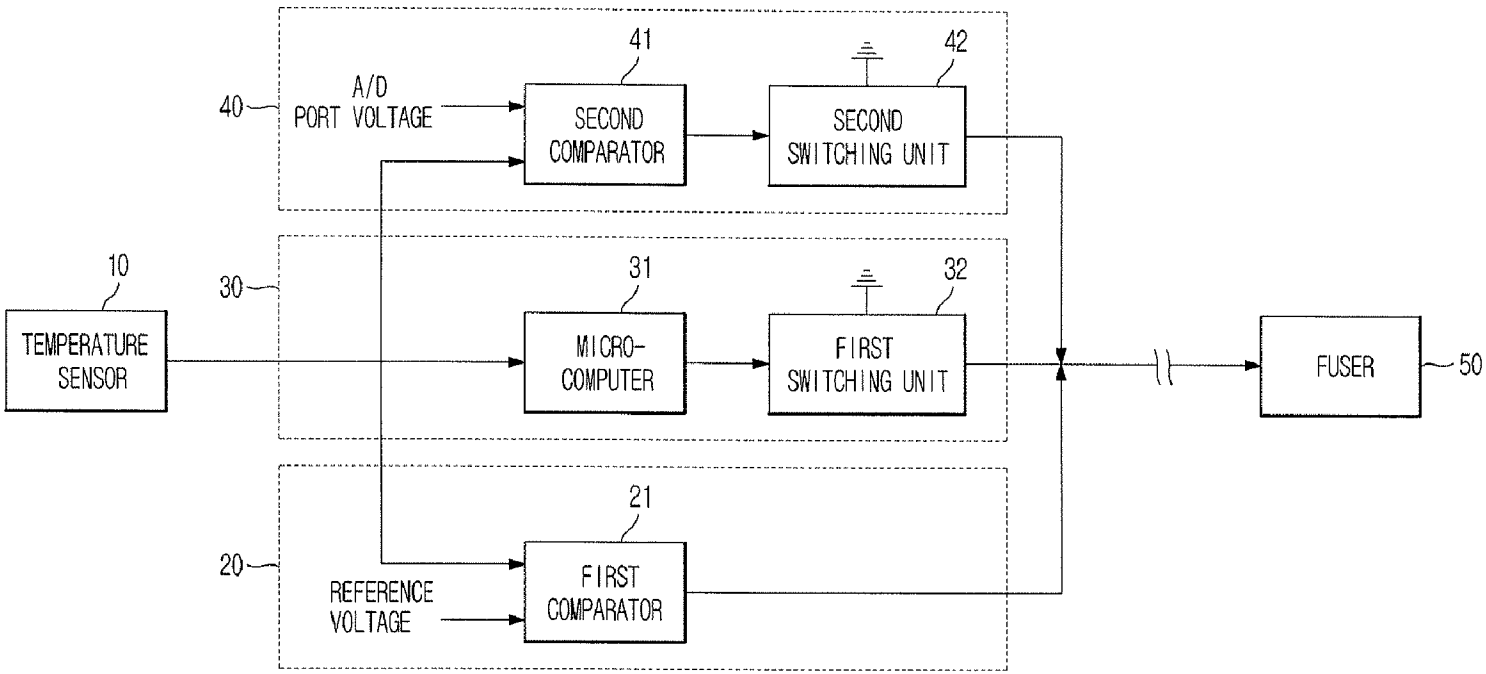
FIG. 2 is a schematic control block diagram of an image forming apparatus according to an embodiment of the present general inventive concept.

FIG. 2 is a schematic control block diagram of an image forming apparatus according to an embodiment of the present general inventive concept. As illustrated in FIG. 2, the image forming apparatus according to the present embodiment includes a temperature sensor 10, a first overheating prevention unit 20, a controller 30, and a second overheating prevention unit 40. The temperature sensor 10 senses the temperature of a fuser 50. The first overheating prevention unit 20 compares a voltage detected by the temperature sensor 10 to a preset reference voltage, and turns off the fuser 50 when the fuser 50 overheats based on the comparison. The controller 30 receives the voltage detected by the temperature sensor 10 through an analog-to-digital (A/D) port and performs on/off control of the fuser 50 so that the temperature of the fuser 50 is kept at a predetermined level. The second overheating prevention unit 40 compares the A/D port voltage with the voltage detected by the temperature sensor 10, and turns off the fuser 50 when a voltage difference occurs due to damage to the A/D port.

Figure 3:
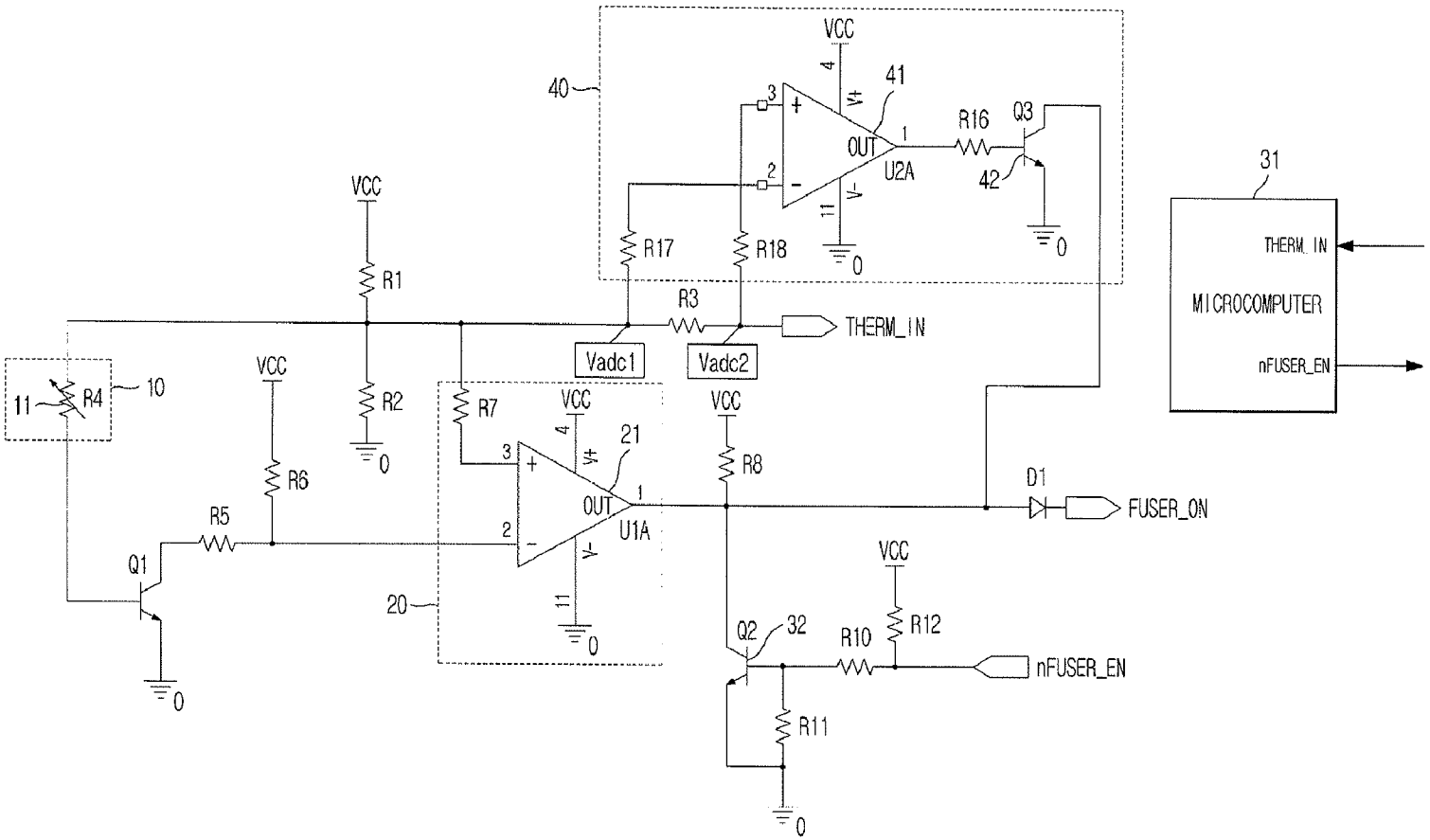
FIG. 3 is a schematic circuit diagram of the image forming apparatus of FIG. 2.

The above components of FIG. 2 are described below in more detail with reference to FIG. 3. The temperature sensor 10 includes a thermistor 11. The thermistor 11 detects the temperature of the fuser 50, particularly surface temperature of a fuser roller in the fuser 50. One end of the thermistor 11 is connected to a positive (+) input of a first comparator 21 via a resistor R7, and is connected to an A/D port (THERM_IN) of a microcomputer 31 via a resistor R3. Thus, the voltage detected by the thermistor 11 is input to both the A/D port (THERM_IN) of the microcomputer 31 and a negative (−) input of the first comparator 21. The other end of the thermistor 11 is connected to a base of a transistor Q1. An emitter of the transistor Q1 is grounded and a collector thereof is connected to the negative input of the first comparator 21, via a resistor R5.

The first overheating prevention unit 20 includes the first comparator 21. The first comparator 21 compares the voltage detected by the thermistor 11, applied to the positive input of the first comparator 21, with the reference voltage applied to the negative input of the first comparator 21. If the detected voltage is higher than the reference voltage, the first comparator 21 outputs a high level, and if the detected voltage is lower than or equal to the reference voltage, the first comparator 21 outputs a low level. Thus, the first comparator 21 outputs a high level in a normal operating state controlled at a temperature within an allowable temperature range, and outputs a low level in an abnormal operating state controlled at a temperature outside the allowable temperature range. When the output level of the first comparator 21 is high, the fuser 50 is turned on or off according to a control signal output through an output port (nFUSER_EN) of the microcomputer 31. However, when the output level of the first comparator 21 is low, the fuser 50 is turned off regardless of the control signal output through the output port (nFUSER_EN) of the microcomputer 31.

The controller 30 includes the microcomputer 31 and a first switching unit 32. The microcomputer 31 reads the voltage detected by the thermistor 11 through the A/D port (THERM_IN) and outputs a control signal to the first switching unit 32 through the output port (nFUSER_EN). Accordingly, the control signal output from the microcomputer 31 causes the fuser 50 to turn on or off so that a temperature level corresponding to the read detected voltage is kept at a target temperature level stored in an internal memory. The first switching unit 32 includes a transistor Q2 that is connected at its collector to the output of the first comparator 21. An emitter of the transistor Q2 is grounded and a base thereof is connected to the output port (nFUSER_EN) of the microcomputer 31 via a resistor R10. Accordingly, when the transistor Q2 is turned on according to the control signal from the microcomputer 31, the output voltage of the first comparator 21 drops to a low level to output a low-level FUSER_ON signal to the fuser 50, thereby turning off the fuser 50. In contrast, when the transistor Q2 is turned off according to the control signal of the microcomputer 31, a FUSER_ON signal at the same voltage level as the output voltage of the first comparator 21 is output to the fuser 50, and therefore the fuser 50 is turned on if the output voltage of the first comparator 21 is high.

The second overheating prevention unit 40 includes a second comparator 41 and a second switching unit 42. The second comparator 41 compares an A/D port (THERM_IN) voltage of the microcomputer 31 applied to a positive (+) input of the second comparator 41 with the voltage detected by the thermistor 11 applied to a negative (−) input thereof. If the A/D port (THERM_IN) voltage is higher than the detected voltage, the second comparator 41 outputs a high level, and if the detected voltage is lower than or equal to the detected voltage, the second comparator 41 outputs a low level. The second switching unit 42 includes a transistor Q3 that is connected at a base thereof to the output of the second comparator 41, via a resistor R16. An emitter of the transistor Q3 is grounded and a collector thereof is connected to both the output of the first comparator 21 and the collector of the transistor Q2. Accordingly, the transistor Q3 is turned off when the output level of the second comparator 41 is low, and the transistor Q3 is turned on when the output level of the second comparator 41 is high. Accordingly, when the transistor Q3 is turned on, the output of the first comparator 21 and the collector of the transistor Q2 drop to low, so that a low-level FUSER_ON signal is output to turn off the fuser 50. In contrast, when the A/D port (THERM_IN) of the microcomputer 31 is normal, voltages Vadc1 and Vadc2 at both ends of the resistor R3 are equal so that the output level of the second comparator 41 is low, and therefore the transistor Q3 is kept off, thus exerting no influence on the control of the fuser 50. However, when electrostatic discharge, power line surge voltage, or similar unplanned electrical disruptions damage the A/D port (THERM_IN) of the microcomputer 31, the voltages Vadc1 and Vadc2 at both ends of the resistor R3 are not equal. Specifically, when the A/D port (THERM_IN) of the microcomputer 31 is damaged, a certain voltage is applied to the A/D port (THERM_IN) so that the A/D port (THERM_IN) functions as another voltage source to cause a voltage difference between both ends of the resistor R3. Thus, the voltage Vadc2 applied to the positive input of the second comparator 41 exceeds the voltage Vadc1 applied to the negative input thereof, which causes the second comparator 41 to output a high level. Accordingly, the transistor Q3 turns on to change its collector signal to low, so that the FUSER_ON signal drops to low, thereby turning off the fuser 50.

The following is a description of how the image forming apparatus configured as described above with reference to FIG. 3 operates. The microcomputer 31 A/D converts and reads a voltage detected by the thermistor 11 through the A/D port (THERM_IN). The microcomputer 31 compares the temperature corresponding to the read voltage with a target temperature previously stored in the ROM and determines whether to turn on or off the fuser 50 at the current time. The microcomputer 31 then outputs a control signal corresponding to the determination through the output port (nFUSER_EN) to turn on or off the transistor Q2 to perform on/off control of the fuser 50. Accordingly, the first comparator 21 compares the voltage detected by the thermistor 11 applied to its positive input with a reference voltage which is a maximum allowable level in the system. If the detected voltage is higher than the reference voltage, the first comparator 21 outputs a high level, otherwise the first comparator 21 outputs a low level.

When the A/D port (THERM_IN) of the microcomputer 31 is damaged by external factors and thus functions as a voltage source, the Vadc2 voltage becomes higher than the Vadc1 voltage as described above. This causes an increase in the level of the Vadc1 voltage. Thus, the voltage applied to the positive input of the first comparator 21 becomes higher than the reference voltage applied to the negative input, resulting in detection of a normal operating state controlled at a temperature within an allowable temperature range. Since the first comparator 21 outputs a high level even in such a state where it should output a low level, the fuser 50 is maintained in a turned-on state which could seriously overheat the fuser 50.

Accordingly, the voltage (Vadc2) applied to the positive input of the second comparator 41 exceeds the voltage (Vadc1) applied to the negative input to switch the output level of the second comparator 41 from low to high. This turns on the transistor Q3 to switch the signal of its collector to low. Consequently, the FUSER_ON signal drops to low, thereby turning off the fuser 50.

As is apparent from the above description, the present general inventive concept provides an image forming apparatus that includes not only a first overheating prevention unit to prevent overheating of its fuser, but also a second overheating prevention unit to additionally prevent overheating of the fuser. The second overheating prevention unit is designed such that when an A/D port of a microcomputer of the image forming apparatus is damaged, voltage of the A/D port increased by the damage activates the second overheating prevention unit to turn off the fuser. This prevents overheating of the fuser caused by malfunction of the A/D port of the microcomputer, thereby preventing the fuser from seriously overheating and causing disconnection of the thermostat or scorch of the fuser.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus to prevent overheating of a fuser, the apparatus comprising:

a temperature sensor to sense a temperature of the fuser;

a first overheating prevention unit to compare a voltage detected by the temperature sensor with a preset reference voltage and to turn off the fuser when the fuser overheats;

a controller to receive the voltage detected by the temperature sensor through an A/D port and to perform on/off control of the fuser to keep the temperature of the fuser at a predetermined level; and a second overheating prevention unit to compare the voltage detected by the temperature sensor with a voltage of the A/D port and to turn off the fuser when the detected voltage is different from the voltage of the A/D port.

2. The image forming apparatus according to claim 1, wherein the temperature sensor includes a thermistor to sense a surface temperature of a fuser roller in the fuser.

3. The image forming apparatus according to claim 1, wherein the first overheating prevention unit outputs a signal to turn on the fuser if the voltage detected by the temperature sensor is higher than the preset reference voltage and outputs a signal to turn off the fuser if the voltage detected by the temperature sensor is less than or equal to the preset reference voltage.

4. The image forming apparatus according to claim 1, wherein the controller comprises:

a microcomputer to read the voltage detected by the temperature sensor through an A/D port and to output a control signal through an output port, the control signal causing temperature corresponding to the read voltage to be maintained at a preset target temperature; and a first switching unit that is turned on or off according to the control signal output from the microcomputer to turn on or off the fuser.

5. The image forming apparatus according to claim 1, wherein the second overheating prevention unit comprises:

a second comparator to output a first signal if the voltage of the A/D port is higher than the detected voltage and to output a second signal if the voltage of the A/D port is less than or equal to the detected voltage; and a second switching unit that is turned on or off according to the first signal output from the second comparator to turn on or off the fuser.

6. An image forming apparatus to prevent overheating of a fuser, the apparatus comprising:

a temperature sensor to detect a voltage which corresponds to temperature of the fuser;

a controller to output a control signal to turn the fuser on or off based on the voltage detected by the temperature sensor in order to maintain a target temperature of the fuser;

an overheating prevention unit to compare the detected voltage to a reference voltage and to turn the fuser on or off based on a signal produced by the comparison and the control signal output from the controller; and another overheating prevention unit to compare a voltage at the A/D port with the voltage detected by the temperature sensor to turn the fuser off or to maintain a current state of the fuser.

7. The image forming apparatus of claim 6, wherein the fuser turns on only if the comparison signal is in a fuser-on state and the control signal is in a fuser-on state.

8. The image forming apparatus of claim 6, wherein the controller comprises:

a microcomputer to read the voltage detected by the temperature sensor through an A/D port and to output the control signal.

9. The image forming apparatus of claim 6, wherein the another overheating prevention unit turns the fuser off when the voltage at the A/D port is higher than the detected voltage.

10. The image forming apparatus of claim 6, wherein the another overheating prevention unit turns the fuser off when the A/D port is damaged.

11. The image forming apparatus of claim 8, wherein the microcomputer outputs the control signal to a switching unit which controls whether the fuser turns on or off.

12. The image forming apparatus of claim 11, wherein the fuser turns on when the switching unit is off and the fuser turns off when the switching unit is on.

13. The image forming apparatus of claim 12, wherein the fuser is turned on if the voltage detected by the temperature sensor is higher than the reference voltage.

14. A method of controlling a fuser in an image forming apparatus, the method comprising:

detecting a voltage of the fuser which corresponds to temperature of the fuser;

comparing the detected voltage with a preset reference voltage to turn off the fuser when the fuser overheats;

receiving the detected voltage through an A/D port to perform on/off control of the fuser to keep the temperature of the fuser at a predetermined level; and comparing the detected voltage with a voltage of the A/D port to turn off the fuser when the detected voltage is different from the voltage of the A/D port.

15. The method of claim 14, further comprising:

outputting a first signal if the voltage of the A/D port is higher than the detected voltage; and outputting a second signal if the voltage of the A/D port is less than or equal to the detected voltage.

16. A method of controlling a fuser in an image forming apparatus, the method comprising:

detecting a voltage which corresponds to temperature of the fuser;

outputting a control signal to turn the fuser on or off based on the detected voltage in order to maintain a target temperature of the fuser;

comparing the detected voltage to a reference voltage;

turning the fuser on or off based on a signal produced by the comparison and the output control signal; and comparing a voltage at an A/D port with the voltage detected by a temperature sensor to turn the fuser off or to maintain a current state of the fuser.

17. The method of claim 16, further comprising:

reading the voltage detected by the temperature sensor through an A/D port.

18. The method of claim 16, wherein the fuser is turned off when the voltage at the A/D port is higher than the detected voltage.

* * * * *